United States Patent [19]

Bennett et al.

[11] Patent Number: 4,900,264

[45] Date of Patent: Feb. 13, 1990

[54] ELECTRICAL CONNECTOR AND METHOD OF INTERCONNECTING FLAT POWER CABLES

[75] Inventors: Glenn E. Bennett, Glendale; Frank H. Bermier, Jr., Tempe; John K. Daly; Robert K. Grebe, both of Scottsdale; Earl R. Kreinberg, Phoenix; Dean A. Puerner, Maricopa, all of Ariz.

[73] Assignee: AMP Incorporated, Harrisburg, Pa.

[21] Appl. No.: 341,864

[22] Filed: Apr. 21, 1989

[51] Int. Cl.[4] ..... H01R 4/24

[52] U.S. Cl. ..... 439/391; 439/422

[58] Field of Search ..... 439/389–426

[56] References Cited

U.S. PATENT DOCUMENTS

| | | | |
|---|---|---|---|
| Re. 31,336 | 8/1983 | Weinmann et al. | 29/868 |
| 521,825 | 6/1894 | Shipe . | |
| 2,020,408 | 11/1935 | Fruth | 175/315 |
| 2,080,750 | 5/1937 | Thompson | 29/149.5 |
| 3,138,658 | 6/1964 | Weimer, Jr. | 174/94 |
| 3,193,921 | 7/1965 | Kahn | 29/509 |
| 3,197,729 | 7/1965 | Sarazen | 339/97 |
| 3,247,316 | 4/1966 | Weimer, Jr. | 174/94 |
| 3,336,564 | 8/1967 | McCaughey | 439/391 |
| 3,728,473 | 4/1973 | Kuo | 174/84 C |
| 3,752,901 | 8/1973 | Kuo | 174/84 C |
| 3,881,796 | 5/1975 | Saunders | 439/422 |
| 4,015,328 | 4/1977 | McDonough | 29/625 |
| 4,059,897 | 11/1977 | Marquis | 29/432.1 |
| 4,241,498 | 12/1980 | Brandeau | 29/861 |
| 4,248,493 | 2/1981 | Kuo | 339/97 R |
| 4,249,304 | 2/1981 | Weinmann et al. | 29/872 |
| 4,357,065 | 11/1982 | Kam et al. | 339/97 R |
| 4,551,579 | 11/1985 | Takasaki | 439/422 |
| 4,620,758 | 11/1986 | Frola | 339/22 B |
| 4,821,409 | 4/1989 | Nager, Jr. | 29/747 |
| 4,832,625 | 5/1989 | Puerner | 439/681 |
| 4,834,673 | 5/1989 | Beinhaur et al. | 439/422 |

FOREIGN PATENT DOCUMENTS 48-30780 4/1973 Japan .

OTHER PUBLICATIONS

AMP Data Sheet 74–279, issued 7–84; "AMP Termi--Foil Terminals and Splices"; AMP Incorporated; Harrisburg, PA.

*Primary Examiner*—Joseph H. McGlynn
*Attorney, Agent, or Firm*—Anton P. Ness

[57] ABSTRACT

Two flat cables are interconnected to comprise a tap connection or a splice connection by stacking them and pressing together against them an assembly of upper and lower interconnecting structures which include opposing regions of alternating shearing wave shapes and relief recesses. The wave shapes shear the conductors of the cables and extrude the thus-sheared conductor strips into the opposing relief recesses so that newly sheared conductor edges are moved adjacent electrical engagement surfaces defined by vertical edges of the adjacent wave shapes. Dual conductor cables have their respective conductors interconnected by using a pair of assemblies of upper and lower interconnecting structures, each assembly having shearing wave shapes and relief recesses disposed transversely across only the half of the cables within which the appropriate conductors are disposed. The upper and lower structures can include lateral flanges which are riveted together after termination to the cables to lock the upper and lower structures together. A pair of housing members can be latched together to house the assemblies of interconnecting structures terminated to the cables.

29 Claims, 8 Drawing Sheets

ELECTRICAL CONNECTOR AND METHOD OF INTERCONNECTING FLAT POWER CABLES

FIELD OF THE INVENTION

The present invention relates to the field of electrical connections and more particularly to interconnecting flat power cables.

BACKGROUND OF THE INVENTION

U.S. patent application Ser. Nos. 07/298,259 and 07/193,852 disclose a transition adapter which is crimped onto a flat power cable by penetrating the insulation covering the cable's conductor and also shearing through the conductor at a plurality of locations. The cable is of the type entering commercial use for transmitting electrical power of for example 75 amperes nominal, and includes a flat conductor one inch wide and about 0.020 inches thick with an extruded insulated coating of about 0.004 to 0.008 inches thick over each surface with the cable having a total thickness averaging about 0.034 inches. One embodiment of the transition adapter is stamped and formed of sheet metal and in one embodiment includes a pair of opposing plate sections disposed along respective major surfaces of the cable and including opposing termination regions extending transversely across the cable. Each terminating region includes a transverse array of alternating shearing wave shapes and relief recesses of equal width, the relief recesses defined by arcuate projections extending away from the cable-proximate side, and the wave shapes extending outwardly from the cable-proximate side and toward relief recesses in the opposed plate section. Each shearing wave shape has a transverse crest between parallel side edges, and the side edges of the corresponding relief recesses are associated with the wave side edges to comprise pairs of shearing edges, preferably with zero clearance. When the plate sections are pressed against a cable section disposed therebetween the crests of the wave shapes initiate cable shearing by their axially oriented side edges cutting through the cable insulation and into and through the metal conductor. The wave shapes extrude the sheared cable strips outwardly into the opposing relief recesses as the shears propagate axially along the cable for limited distances, forming a series of interlocking wave joints with the cable while exposing newly sheared edges of the cable conductor for electrical connection therewith.

Further with regard to the transition adapter of the above applications, fastened to the outwardly facing surface of the plate sections at the terminating regions are respective inserts of low resistance copper. The inserts have adapter-facing surfaces conforming closely to the shaped outer surface of the terminating region, with alternating wave shapes and apertures disposed outwardly of and along the adapter wave shapes and relief recesses. Upon termination the wave joints are within the insert apertures, and the sheared edges of the adjacent conductor strips and of the adapter wave shapes which formed the sheared strips are adjacent to side surfaces of the copper insert apertures. A two-step staking process is preferred: in a first step the wave joints are split axially so that portions of each arcuate shape of both adapter plate sections are forced inwardly against the adjacent sheared conductor strip of the respective wave joint to define spring fingers whose ends pin the conductor strip against the opposing wave crest to store energy in the joint; and in the second step a staking process deforms the insert between the sheared strips to deform the copper against the sheared conductor and wave shape edges, forming gas-tight, heat and vibration resistant electrical connections with the cable conductor and with the transition adapter, so that the inserts are electrically in series at a plurality of locations between the conductor and the adapter.

A contact section is integrally included on the transition adapter enabling mating with corresponding contact means of a electrical connector, or a bus bar, or a power supply terminal, for example, and can include a plurality of contact sections to distribute the power to a corresponding plurality of contact means if desired. A housing or other dielectric covering can be placed around the termination as desired, such as is disclosed in U.S. patent applications Ser. Nos. 07/234,063 filed Aug. 18, 1988 and 07/338,790 filed Apr. 14, 1989, both assigned to the assignee hereof.

Also entering commercial acceptance is a dual conductor flat cable, wherein a pair of parallel spaced coplanar flat conductor strips having insulation extruded therearound define power and return paths for electrical power transmission. One method has been devised as disclosed in U.S. Pat. No. 4,241,498 which involves a member associated with one of the two conductors having upper and lower sections joined at a tab. The upper and lower sections are brought along the upper and lower surfaces of the conductor from the side of the cable so that the tab is disposed laterally of the cable. The upper and lower sections have semicylindrical metallic jaws having alternating grooves and lands with the grooves of one jaw adapted to receive thereinto the lands of the opposing jaw when the upper and lower sections are pressed against the conductor. The lands shear strips of the conductor and extrude the sheared strips into the opposing grooves, in a punch and die process. After termination the sheared conductor edges are disposed adjacent sides of the grooves of the semicylindrical jaws to form electrical connections therewith. The tab extends laterally from the cable and is exposed for electrical engagement therewith by another electrical article. The other conductor may be similarly terminated at a nearby location.

In another method for terminating multiconductor flat cable for undercarpet use, an adapter has a plurality of terminals for respective conductors of the cable joined by a strip of dielectric polymeric material, each terminal having an array of upstanding ribs punched out of the plane of the terminal and having vertical sheared edges. The adapter is to be disposed across the cable and the ribs will extend axially along the cable. The cable is prepared by punching therethrough an array of slots corresponding to the ribs, and each slot has a width identical to a rib width. The strip of terminals is placed across the cable so that the ribs extend through the slots and extend beyond the far cable surface far enough so that a tough metal foil tab or strip may be placed under each rib array along the far cable surface. The ribs are then flattened back into the slots, and the foil is thereby pressfitted or wedged between the rib edges and the sheared conductor edges defining the slots forming electrical connections between the terminals and the respective conductors. Solder is placed in the voids of the terminals left from forming the ribs, which also may contribute to a good electrical connection when reflowed to join the terminal to adjacent surfaces of the metal foil tab portions pressed into the cable slots.

It is desired to provide a method for interconnecting single conductor and especially dual conductor flat power cables by forming cable taps and splices.

It is also desired that such interconnection be relatively simple and provide for assured electrical connections which remain gas-tight and heat and vibration resistant over time.

SUMMARY OF THE INVENTION

The present invention provides for the electrical interconnection of one dual conductor flat power cable to another, forming a splice or a tap interconnection between the cables which mechanically joins the cables and electrically interconnects the respective ones of the pairs of cable conductors. The cables are first stacked with the ones of the conductors of each cable to be interconnected being adjacent each other. A pair of wave crimp structures are associated with each pair of conductors to be interconnected, with a lower one of the structures being disposed transversely below the cables and an upper one being disposed transversely above the cables opposed from the lower one; the two pairs of structures for the two pairs of conductors are spaced from each other along the cables and will both be disposed within a common housing at the interconnection site. Each pair of upper and lower structures define opposing arrays of shearing wave shapes and alternating recesses comprising cooperating shearing edges, and the structures will then be pressed against the cables therebetween, shearing strips of the conductors to be interconnected and extruding alternating ones of the strips above and below the planes of the cables and exposing newly sheared conductor edges to be electrically interconnected by metal of the structures. Flanges of the upper and lower structures extend outwardly beyond both lateral edges of the cables and converge, and rivets are placed through aligned holes through the pairs of adjacent flanges and staked to lock the structures to each other sandwiching the cables therebetween. The portions of the other cable conductors disposed between the structures but not being interconnected by the structures are unsheared by the structures but are preferably deformed out of the plane of the cables to relieve stress at the interconnection site.

Each wave crimp structure may comprise an adapter member and an insert member. The adapter member is disposed immediately against the insulated major cable surface, while an associated insert member is secured along the cable-remote surface of the adapter member. Because each structure has a shearing half and a non-shearing half, each adapter has a shearing half and a non-shearing half; the shearing half of both the lower and upper adapters of the pair includes a transverse array of wave shapes extending toward the cable surface and defining shearing members, alternating with arcuate shapes extending away from the cable surface defining relief recesses to receive thereinto the wave shapes of the opposing adapter member and the conductor strips extruded thereby upon shearing during the interconnection process; the non-shearing adapter half of one of the lower and upper adapters includes a single continuous wave having a transverse width greater than the width of the conductor not to be sheared, to extrude a transverse portion of that conductor out of the plane of the cable, while the non-shearing half of the other adapter includes a single arcuate relief recess to receive thereinto the single wave of the opposing adapter and the nonsheared conductor portion extruded thereby.

Each insert member is of low resistance copper and is secured to the cable-remote surface of the associated adapter member, and correspondingly has a shearing half and a non-shearing half. The adapter-facing surface conforms closely to the cable-remote adapter surface, with the shearing half containing alternating wave shapes and apertures disposed outwardly of and along the adapter wave shapes and relief recesses, and the non-shearing half containing a single continuous aperture. Each insert includes flange sections extending from both lateral ends thereof and offset a slight distance toward the cable to be generally disposed in the plane of the near cable, so that upon interconnection the flange sections of the inserts of the opposing structures are adjacent or at least nearly adjacent. The flange sections include central holes therethrough through which rivets will be inserted and staked to lock the opposing inserts to each other; the flange sections preferably also include pairs of holes for alignment pins of the press apparatus which align the opposing structures prior to termination to the cables assuring that the wave shapes and relief recesses are aligned, thereby aligning the cooperating shearing edges to perform the conductor shearing.

Rivets may be secured through the flanges of the lower structures to facilitate the termination procedure, such as by having knurled shaft portions forcefit through the central flange holes; after termination the unheaded rivet ends extend upwardly through the central flange holes of the upper structures and are then staked to form enlarged heads, locking the pairs of flanges together. The flanges may be designed to just engage prior to riveting when used to terminate cables which are thinnest within acceptable specifications for the gage. Where the cables are thicker within the gage or are of a slightly heavier gage, the combined thicknesses of the two cables sandwiched between the structures would tend to cause a slight gap between the flanges; the flanges can be deformed prior to or during riveting to press them together, or alternatively a metal washer can be placed therebetween, to fill the slight gap.

After the structures are pressed together by the terminating apparatus thus shearing and extruding the conductors and defining the interlocking wave joints, preferably the wave joints along the shearing half of the structures are split by being struck by blades of the apparatus extending through the apertures of the inserts; and the outwardly facing surfaces of the inserts preferably are staked at the wave locations to deform the relatively soft copper laterally outwardly and tightly against the adjacent sheared edges of the conductor forming gas-tight and heat and vibration resistant electrical connections therewith, as disclosed in Ser. No. 07/193,852. The completed interconnections of the pairs of conductors by the pairs of structures at the interconnection site are then preferably placed within a pair of housing covers secured together, providing insulation and protection of the terminations and cable strain relief.

It is an objective of the present invention to provide a gas-tight, heat resistant and vibration resistant interconnection between two single conductor or especially dual conductor flat power cables.

An embodiment of the present invention will now be described with reference to the accompanying Figures.

DETAILED DESCRIPTION OF THE PREFERRED EMBODIMENT

Figure 1:
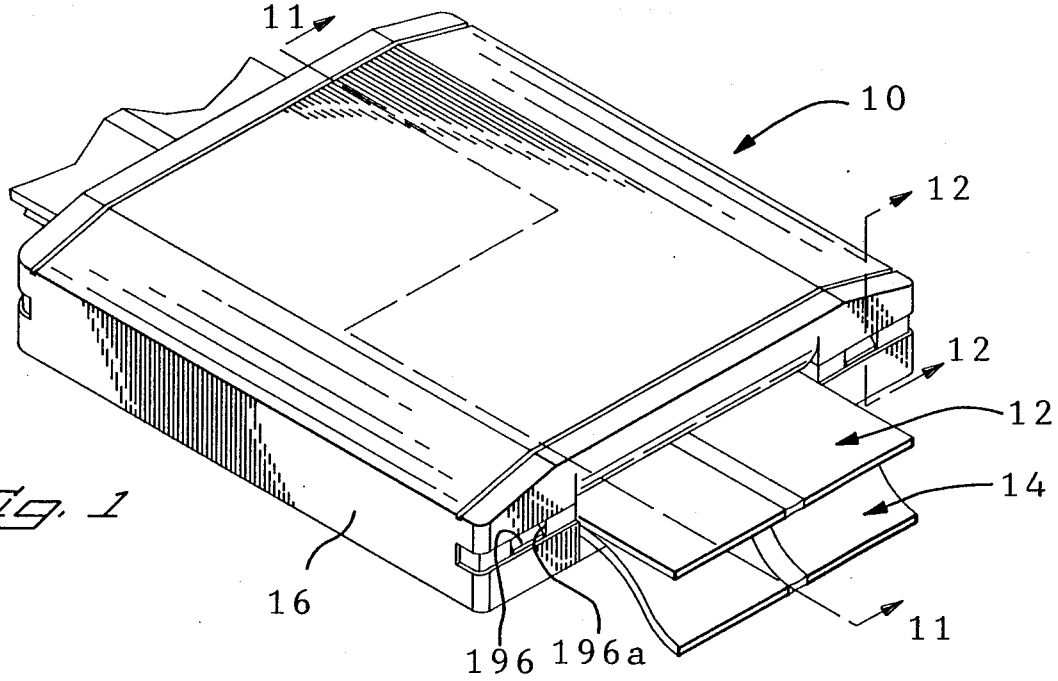
FIG. 1 is a perspective view of a completed, housed in-line tap connection between a main dual conductor flat power cable and a tap cable.
Figure 1A:
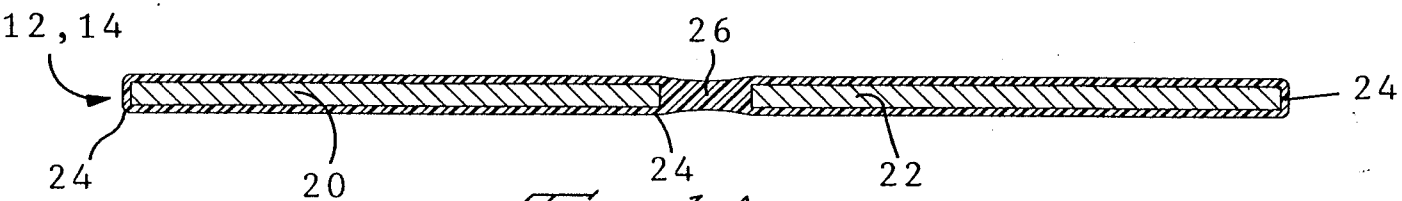
FIG. 1A is a cross-section of a dual conductor flat power cable of the type being interconnected.
Figure 2:
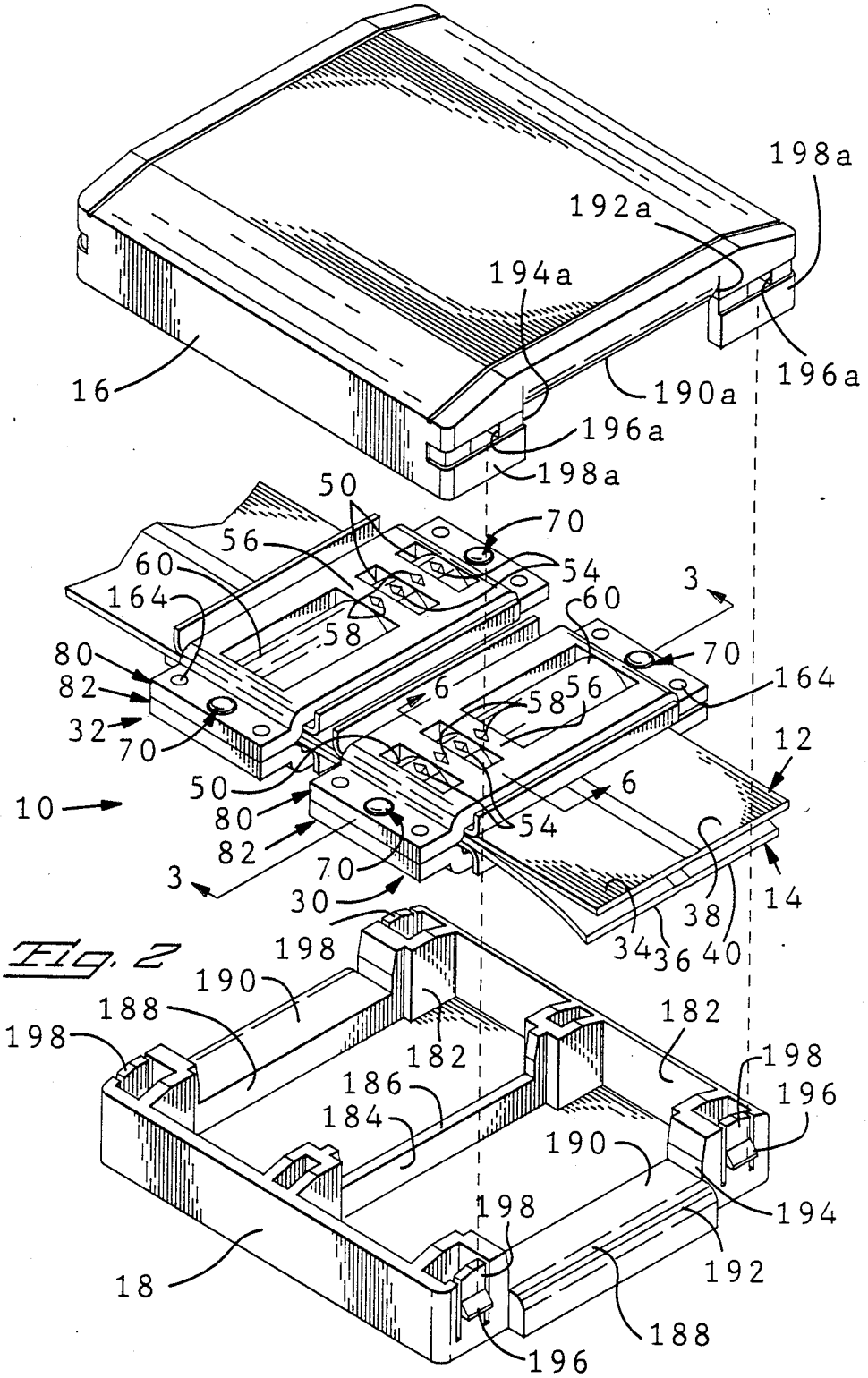
FIG. 2 is a perspective view of the tap connection of FIG. 1 with the housing members exploded from the tap connection, revealing pairs of interconnecting structures of the present invention terminated to and interconnecting respective pairs of conductors of the main and tap cables.

FIGS. 1 and 2 illustrate a tap connection 10 between a main dual conductor flat power cable 12 and a tap cable 14 of similar construction. The housing assembly can comprise upper and lower housing members 16,18 which are secured together such as by latching to provide insulation, cable strain relief and physical protection for the cable interconnection site. FIG. 1A illustrates a typical cross-section of a dual conductor flat power cable 12,14 wherein a pair of flat conductors 20,22 have an insulative coating 24 extruded therearound and defining a medial strip 26 between the conductors.

In FIG. 2 two interconnecting structure assemblies 30,32 are shown each of which interconnects respective ones of the conductors of the main and tap cables, while sandwiching both cables therewithin including the other ones of the conductors. Assembly 30 electrically interconnects conductor 34 of main cable 12 with conductor 36 of tap cable 14, while not interconnecting conductor 38 of main cable 12 and conductor 40 of tap cable 14. Conversely, assembly 32 electrically interconnects conductors 38,40 while not interconnecting conductors 34,36. The interconnections occur at sides of each of a plurality of alternating upper and lower wave joints, upper wave joints 50 being shown on the left side of assembly 30 and on the right side of assembly 32.

Figure 3:
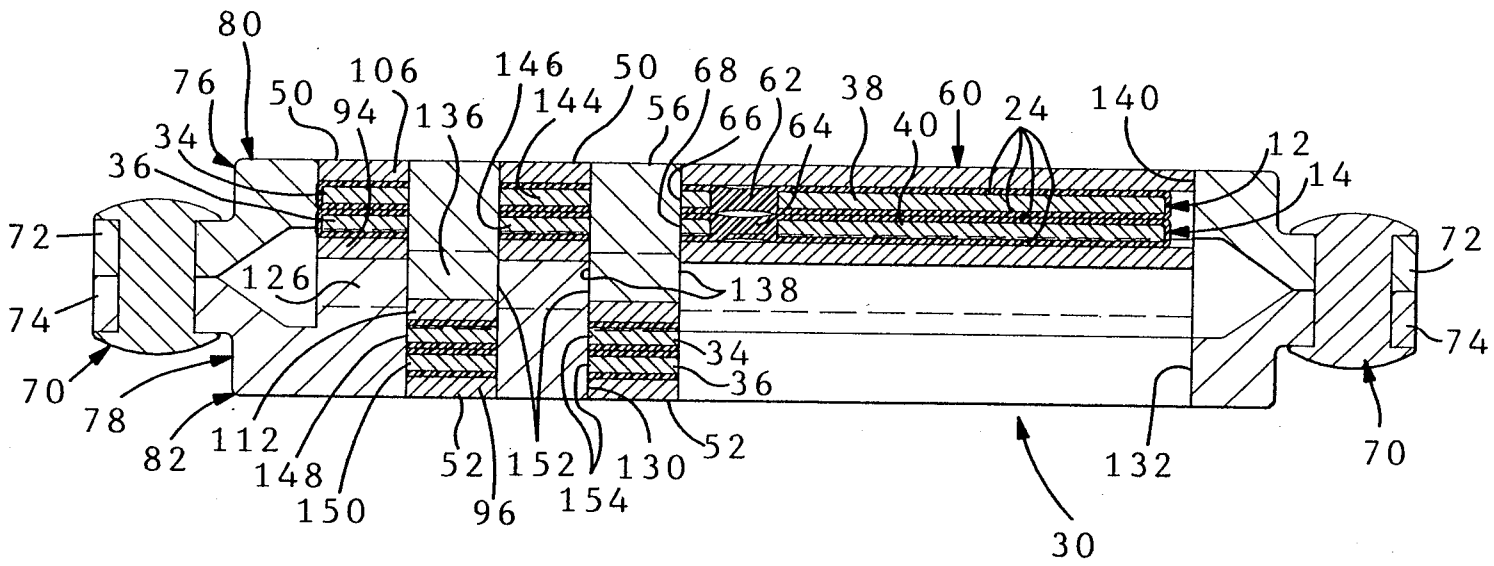
FIG. 3 is a cross-sectional view across a termination, taken generally along lines 3—3 of FIG. 2, showing an array of wave joints interconnecting the conductors of the left side of the main and tap cables, and showing rivets locking the interconnecting structures together.
Figure 4:
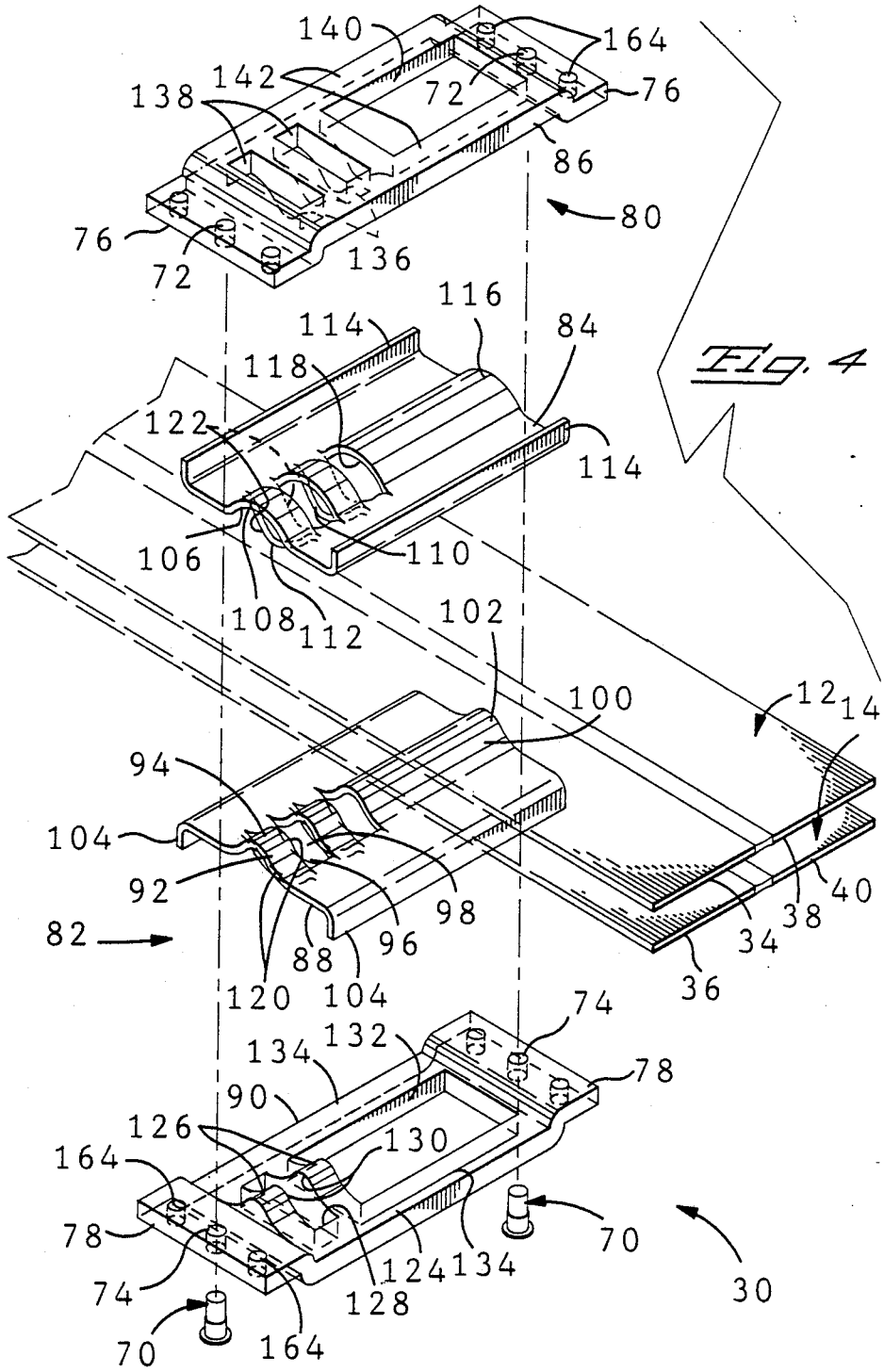
FIG. 4 is a perspective view of one of the conductor interconnections of FIG. 2 with the adapter members and insert members of the upper and lower interconnecting structures exploded from the cables, prior to termination thereto.
Figure 5:
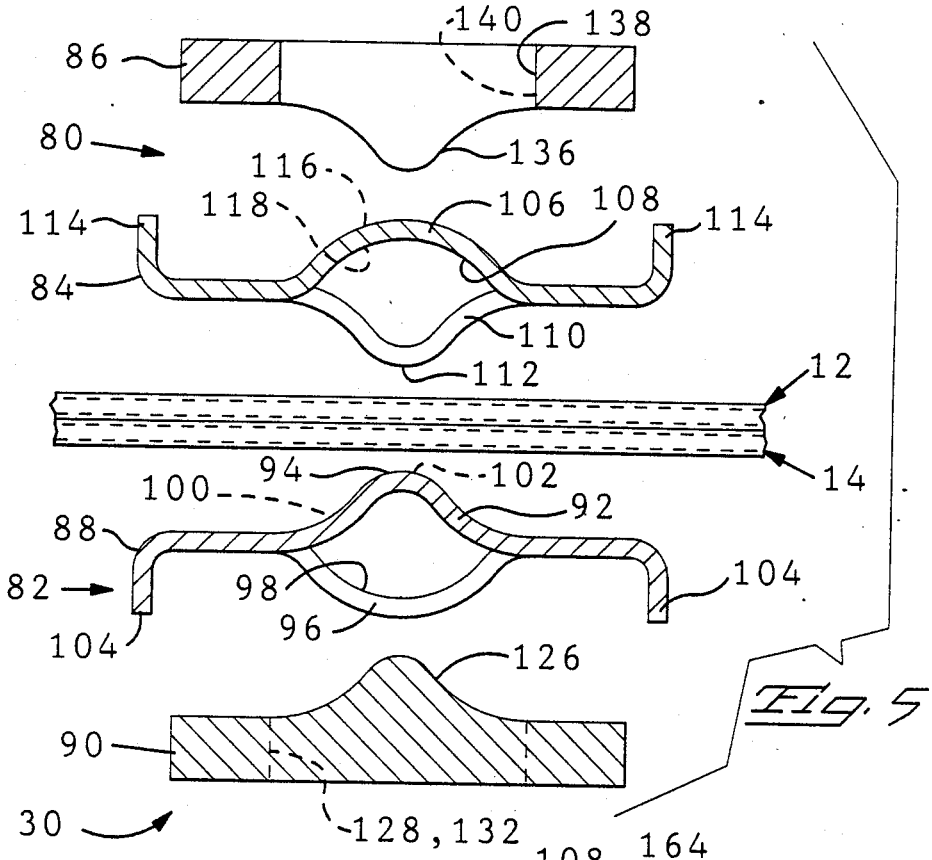
FIG. 5 is a longitudinal section view through a wave joint site showing upper and lower adapter and insert members exploded from the two cables.

FIG. 3 represents a cross-section through interconnecting structure assembly 30, showing the plurality of upper wave joints 50 alternating and interlocking with lower wave joints 52 on the left side which interconnect conductors 34,36. Wave joints 50,52 are similar to the type disclosed in Ser. Nos. 07/298,259 and 07/193,852, which are specifically incorporated hereinto by reference. Each wave joint 50,52 is preferably split as depicted at 54 in FIG. 2 by a staking process which strengthens the joint. Between the upper wave joints 50 are sections of bulk metal 56 of structure assembly 30 which sections are staked as depicted at 58 of FIG. 2 which deforms the bulk metal laterally tightly against the sheared edges of the conductors 34,36 forming gas-tight joints therewith; the prior splitting of the wave joints at 54 imparts strong but compliant resistance to the staking of the bulk metal sections and also provides stored energy in the joint which helps maintain the gas-tight nature of the interconnections during in-service use which commonly involves elevated temperatures and vibration. After interconnection and during in-service use, adapter members 84,88 (FIG. 4) assist in confining the relatively yielding conductors 34,36 thereby inhibiting stress relaxation which otherwise would reduce stored energy in wave joints 50,52.

Shown on the right side of FIG. 3 is a wide elevated region 60 which includes the entire width of conductors 38,40 and medial strips 62,64 of both the main 12 and tap 14 cables, and also includes narrow portions 66,68 of conductors 34,36 adjacent their inner edges. This assures that the insulation of the cables at medial strips 62,64 remains intact, protecting inadvertent exposure of conductors 38,40, and also provides structures to cooperate with the staking of innermost bulk section 56 by providing necessary lateral resistance and assuring that a gas-tight connection is made with the adjacent wave joint 50. Preferably the entire region 60 is elevated by reason of being extruded upwardly in order to compensate for the extrusion of conductor strips in the wave joints 50,52 on the left side which otherwise would have resulted in longitudinal stress along the cables 12,14 which could have interfered with the interconnections.

Also seen in FIG. 3 are rivets 70 which extend through centrally located apertures 72,74 of opposing flanges 76,78 of upper interconnecting structure 80 and lower interconnecting structure 82 and lock the structures together to comprise structure assembly 30. The rivets 70 join the flanges spaced laterally from side edges of the cable minimizing a tendency to disturb the wave joints during the process of heading the rivets.

Referring to FIGS. 4 through 7, upper interconnecting structure 80 is comprised of an upper transition adapter member 84 and an upper insert member 86, while lower interconnecting structure 82 is comprised of a lower transition adapter member 88 and a lower insert member 90 and a pair of rivets 70. Adapter members 84,88 may be stamped and formed for example from a sheet of Olin Copper Alloy 197 in half hard temper about 0.025 inches thick which is nickel underplated and silver plated, preferably, and treated for tarnish resistance. Insert members 86,90 may be for example of dead soft Copper CDA 110 generally about 0.066 inches thick which is nickel underplated and silver plated, preferably, and treated for tarnish resistance. Rivets 70 may be for example formed of Copper CDA-110.

Lower adapter 88 includes a pair of upwardly protruding wave shapes 92 each including a wave crest 94 and one being disposed at the lateral edge of the adapter, alternating with a pair of downwardly directed arcuate shapes 96 having widths identical to the width of a wave shape 92 and defining relief recesses 98, all on the left side; the right side includes a single continuous upwardly protruding wave shape 100 having a wave crest 102, and wave shape 100 extends slightly over the center of the adapter onto the left side. Wave crests 94,102 are oriented transverse with respect to the cables. Lower adapter 88 also includes downwardly extending flanges 104 of limited length, along forward and rearward edges.

Upper adapter 84 is similar to lower adapter 88 but configured to cooperate with lower adapter 88. Upper adapter 84 includes a pair of upwardly extending arcuate shapes 106 defining relief recesses 108 opposed from wave shapes 92 of lower adapter 88, one thereof being disposed at the lateral edge; alternating with arcuate shapes 106 are downwardly protruding wave shapes 110 having crests 112; at forward and rearward edges are flanges 114; and on the right side is a single continuous upwardly directed arcuate shape 116 defining a relief recess 118 corresponding with single wave shape 100 of lower adapter 88.

Each wave shape 92 is defined between a pair of parallel vertical side edges 120 extending axially with respect to the cable, and each wave shape 110 is likewise defined between a pair of parallel vertical side edges 122. Together edges 120,122 will cooperate during termination to comprise shearing edges to shear the cable conductors during termination.

Lower insert member 90 has an upper surface 124 which will be disposed against the cable-remote surface of lower adapter 88, and insert surface 124 is shaped to conform closely therewith. Lower insert 90 includes a pair of wave shapes 126 separated by aperture 128 and defining vertical side walls 130 thereof. The right side of lower insert 90 need not be filled by material passing under cable conductors on the right side where large aperture 132 appears between struts 134. Wave shapes 126 correspond with wave shapes 92 of lower adapter 88, and aperture 128 receives arcuate shape 96 thereinto. Likewise upper insert member includes a pair of wave shapes 136 corresponding with wave shapes 112 of upper adapter 84, while apertures 138 receive arcuate shapes 108 thereinto. Large aperture 140 receives large arcuate shape 118 thereinto between struts 142.

Figure 6:
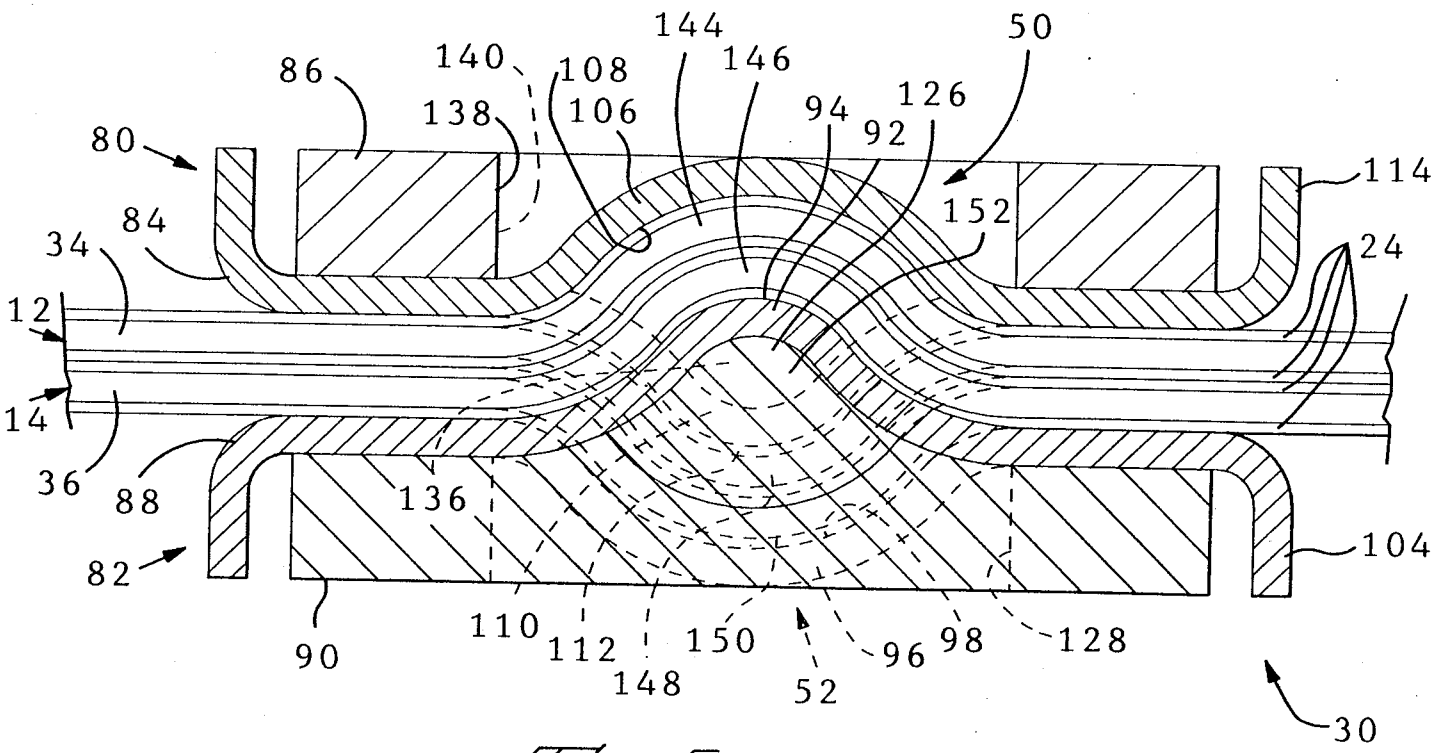
FIG. 6 is a longitudinal section view through a wave joint and generally along lines 6—6 of FIG. 2 showing the wave joint formed by the interconnecting structures of FIG. 5 upon termination to the conductors of the cables being interconnected.

FIG. 6 illustrates the structure of a wave joint 50, and also of a lower wave joint 52 (in phantom), after termination of upper and lower interconnecting structures to main and tap cables 12,14. Side edges 120,122 of wave shapes 92,110 have sheared conductors 34,36 into strips 144,146;148,150 and wave shapes 92,110 have extruded the sheared conductor strips into the opposing relief recesses 108,98 respectively within apertures 138,128. The wave crests 94,112 have been designed and dimensioned with respect to the nominal cable thicknesses so that the newly sheared edges of the sheared conductor strips are extruded past the vertical side edges of the wave shapes of the opposing wave shapes and past substantial vertical areas of the side surfaces of the wave shapes of the opposing inserts. This is indicated in FIG. 6 by the wave overlap area 152, and is best seen in FIG. 3 where newly sheared conductor edges 154 can best be identified. Especially after wave joint splitting and insert wave staking as in FIG. 2 at 54 and 58 by blades of the terminating apparatus after the shearing and extrusion has occurred, assured gas-tight connections are formed between sheared conductor edges 154 and both the metal comprising the side walls of insert apertures 128,138 and the metal comprising the side edges 120,122 of the adapter wave shapes 92,112 at a plurality of locations across the terminating region, interconnecting the conductors 34,36 of the main and tap cables 12,14.

Figure 7:
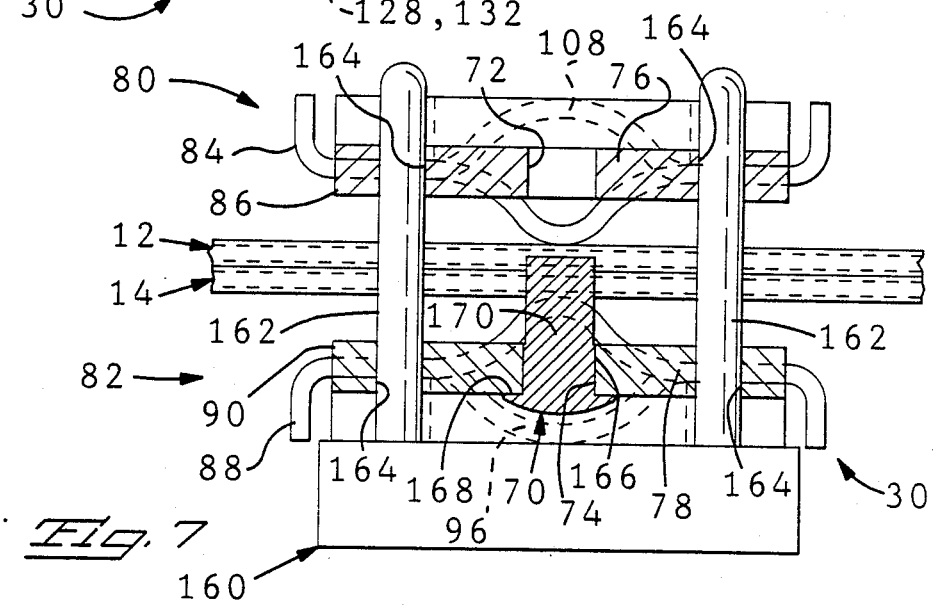
FIG. 7 is a side elevation view of upper and lower interconnecting structures aligned by pins of the terminating apparatus prior to termination, taken through the flanges at one end.

Since the upper and lower interconnecting structures 80,82 are separate pieces prior to termination, an alignment mechanism is provided by the termination apparatus 160, as shown in FIG. 7. Pairs of alignment pins 162 extend upwardly through corresponding holes 164 extending through flanges 78,76 of insert members 90,86 precisely locating and aligning the structures and especially the shearing edges of the adapter wave shapes which are to cooperate with each other to shear the conductors. Insert members 86,90 may be secured to the respective adapter members 84,88 as disclosed in Ser. No. 07/193,852 by a preliminary staking of the insert member outwardly facing surfaces opposed from the wave shapes 136,126 which will slightly deform the metal against the side edges of the arcuate shapes 108,96 enough to hold the members together during routine handling.

Figure 8:
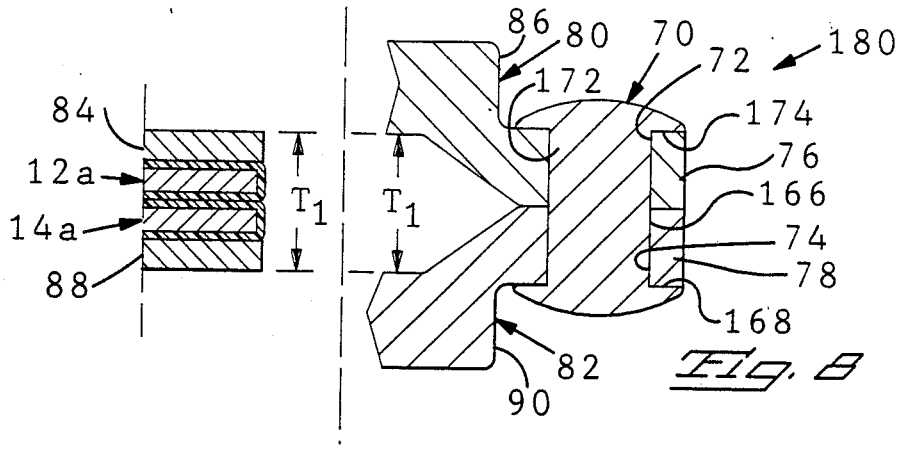
FIG. 8 illustrates the riveting together of a pair of flanges.

FIG. 7 also illustrates that a rivet 70 can be previously secured within a central hole 74 of flange 78 of lower insert member 90 by a knurled larger diameter shank portion 166 adjacent lower head 168 forcefitted into hole 74 having a slightly smaller diameter. Shank portion 170 extends upwardly to be received into central hole 72 of flange 76 of upper insert member 86 upon termination to cables 12,14. FIG. 8 illustrates riveted joint 180 which is the result of staking of the upper end of rivet 70 enlarging shank portion 170 (FIG. 7) into larger shank portion 172 and creating enlarged head 174 formed tightly against the upper surface of flange 76 of upper insert member 86, locking the upper and lower inserts 86,90 together. Preferably the riveting is performed sequentially just after the termination and splitting and staking steps, allowing the terminated assembly to be removed carefully from the alignment pins 162, which are just forwardly and rearwardly from rivets 70, with the interlocking wave joints providing substantial mechanical fastening of the assembly for routine handling prior to riveting. In FIG. 8 the distance $T_1$ between upper insert 86 and lower insert 90 is selected to be equal to the total thickness of the upper and lower adapter 84,88 thicknesses and the thicknesses of main and tap cables **12*a*,14*a* which are at the minimum thickness levels within manufacturing specifications, also designated as $T_1$; flanges 76,78 are formed on upper and lower inserts 86,90** to just meet.

Figure 9:
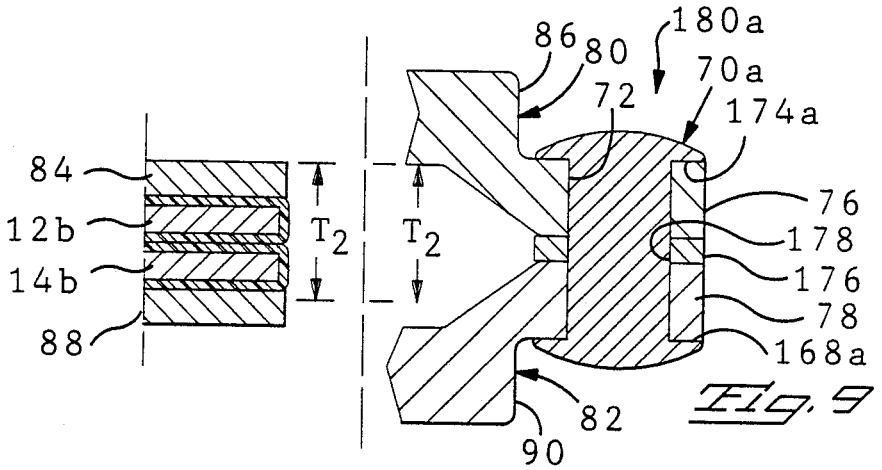
FIG. 9 is an alternate view similar to FIG. 8 wherein a metal spacer is used between the flanges, for interconnecting relatively thick cables.
Figure 10:
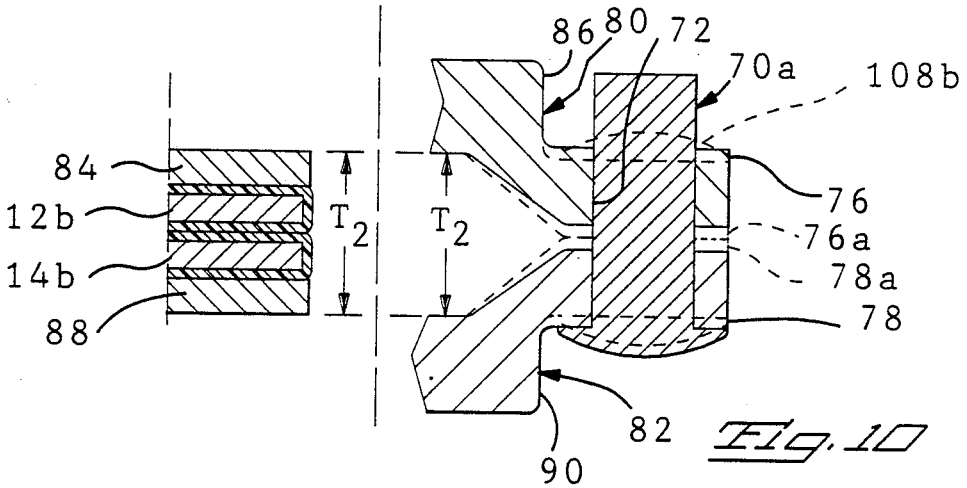
FIG. 10 is another alternate view similar to FIG. 8, wherein the flanges are deflected together to eliminate the gap therebetween resulting from thick cables.

FIGS. 9 and 10 represent riveted joints where the main and tap cables have thicknesses greater than the minimum permitted by manufacturing specifications within the gage for which the particular interconnecting structures of the present invention have been manufactured, or be of a slightly heavier gage. In FIG. 9 riveted joint 180a comprises a metal washer 176 placed between upper and lower flanges 76,78 prior to staking rivet 70a, which may be selected to be slightly longer than rivet 70; metal washer 176 may be annular or may have a profiled shape generally the same as flanges 76,78 and has an aperture 178 therethrough with a diameter equal to that of aperture 72 through upper flange 76 so that the upper shank portion of rivet 70a is insertable therethrough and through aperture 72 in upper flange 76 prior to staking. Washer 176 thus is a shim or spacer mechanism for filling the gap between upper and lower flanges 76,78 which would otherwise be the result of thicker cables 12b,14b and is selected to have a thickness equal to the amount by which distance $T_2$ exceeds $T_1$. In FIG. 10 compensation for the gap is shown to be attained by striking the flanges prior to or optionally simultaneously with the staking of rivet 70a to deformingly deflect flanges 76,78 together to overcome the gap, with the deflected flanges 76a,78a and then riveted joint 180b indicated in phantom, where distance $T_2$ is greater than $T_1$ as in FIG. 9.

Figure 11:
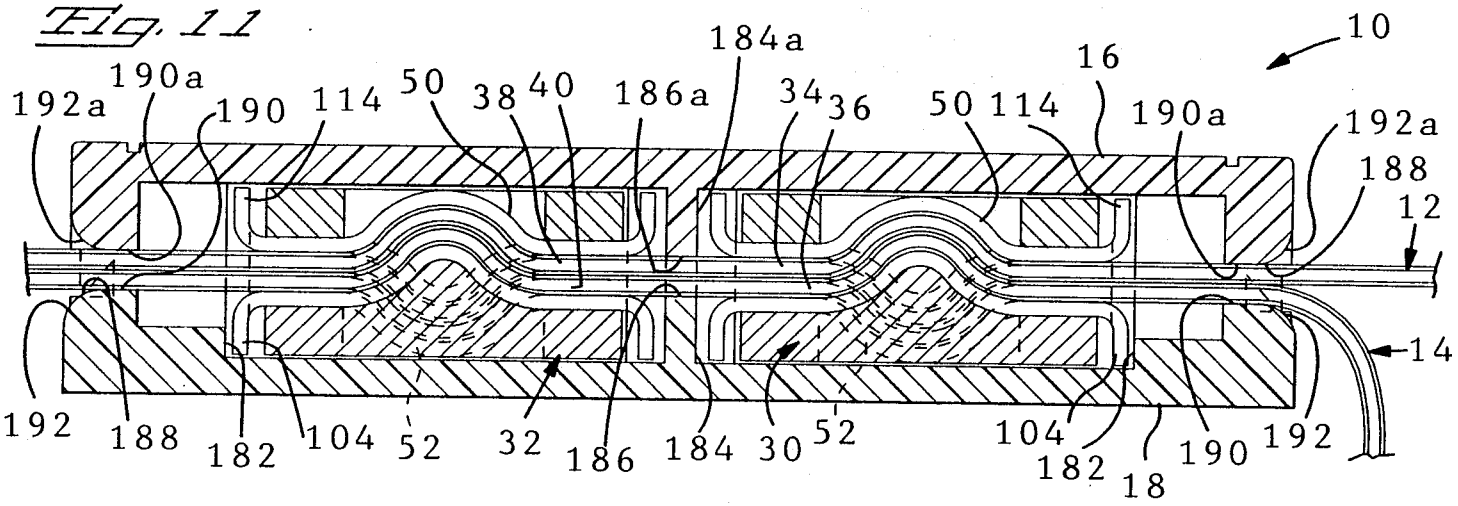
FIG. 11 is a longitudinal section view taken along line 11—11 of FIG. 1, showing the housed in-line tap connection.

FIG. 11 is a section taken longitudinally through the housed tap connection of FIG. 1, showing both interconnecting structure assemblies 30 and 32 terminated to main and tap cables 12,14. Assembly 30 interconnects conductors 34,36 on the left side of cables 12,14 in FIG. 2 while assembly 32 interconnects conductors 38,40 on the right side in FIG. 2. Assembly 32 can be identical to assembly 30 except rotated 180° in a horizontal plane so that the wave shapes of the upper and lower adapter members and insert members are disposed on the right side of cables 12,14 in FIG. 2, to terminate conductors 38,40 on the right side. Lower housing member 18 includes large cavities 182 to receive assemblies 30,32 respectively thereinto, with upper housing 16 dimensioned to fit over and outside the side walls of lower housing 18, upon housings 16,18 being secured together. Cavities 182 are separated by medial wall portion 184 of lower housing 18 and a corresponding wall portion 184a of upper housing 16 opposed therefrom, having horizontal wall surfaces 186,186a which approximately abut upper and lower surfaces of cables 12,14 extending completely through housings 16,18.

In FIG. 11 it can be seen that flanges 116,104 of upper and lower adapter members 84,88 are dimensioned to almost abut inside surfaces of upper and lower housings 16,18 upon assembly, which along with wall portions 184,184a provide minimal looseness of fit of the assemblies 30,32 terminated to cables 12,14 but allow for slight variations in the thickness of the cables. Cable exits 188 are defined by surfaces 190,190a of lower and upper housings 18,16 respectively which when housings 16,18 are secured together approximately abut upper and lower surfaces of cables 12,14 at locations spaced axially selected distances from the wave joints 50,52. Outer edges 192,192a of surfaces 190,190a are rounded thus providing fulcra spaced axially from the interconnection sites in the event the cables become bent or stressed upwardly or downwardly. Side walls 194,194a (FIG. 2) of cable exits 188 are dimensioned preferably to be incrementally smaller than standard cable widths to impinge on the cables for a slight interference fit, serving to secure the cables against looseness within the housings. The housings are thus adapted to provide cable strain relief and protect the wave joint interconnection sites from strain, torque and vibration.

Figure 12:
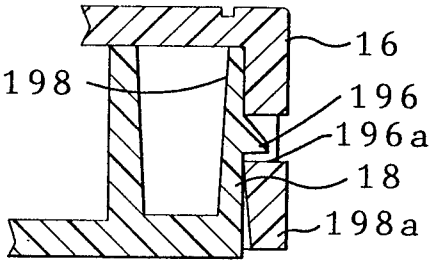
FIG. 12 is an enlarged view of the latching system of the housing members.

With reference to FIGS. 12 and 2, housings 16,18 are shown secured together by integral latch projections 196 preferably disposed on deflectable latch arms 198 extending upwardly from the base of lower housing 18, which latch into latching recesses 196a on vertical portions 198a of upper housing 16. Other securing mechanisms may be used if desired.

Figure 13:
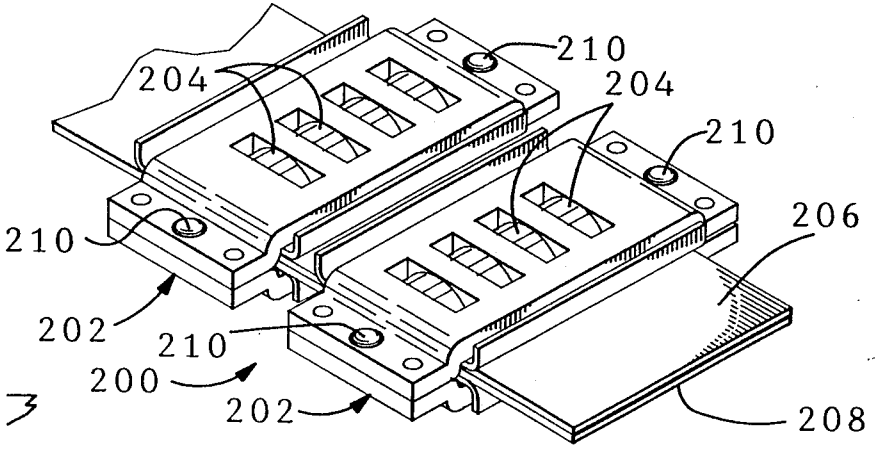
FIG. 13 is a tap connection of two single conductor flat power cables similar to FIG. 2, using interconnection structure assemblies both forming wave joints completely across the cables and riveted together.

The tap connections of the present invention may also be used with single conductor flat cable, and the same interconnecting structures assemblies 30,32 may be used and assembled in the same manner as in FIGS. 2 to 12. Modified interconnecting structure assemblies may also be used to form a tap or splice interconnection 200 as shown in FIG. 13, in which one or preferably a pair of identical adapter and insert assemblies 202 having wave shapes and relief recesses and apertures entirely thereacross to form a plurality of upper and lower wave joints 204 with main cable 206 and tap cable 208 (or two main cable ends, for a splice) entirely thereacross after which the structures are locked together by rivet joints 210 as in FIGS. 7 through 10, and housings may be used therewith as shown in FIGS. 2 and 11.

Modifications and variations may be made in the embodiment described in detail herein, which are within the spirit of the invention and the scope of the claims.

What is claimed is:

1. An interconnection of two flat power cables each having at least one flat conductor therein, comprising:

a first flat power cable having at least one flat conductor therein, and a second flat power cable having a corresponding at least one flat conductor therein;

at least one interconnecting structure assembly corresponding to each said at least one conductor, each said assembly having an upper structure and a lower structure joined together with selected sections of said first and second cables disposed therebetween, each said assembly having a plurality of shearing wave shapes alternating with relief recesses along a cable-proximate surface of said upper structure, and a cooperating plurality of shearing wave shapes and alternating relief recesses along a cable-proximate surface of said lower structure, each said wave shape being opposed by a said relief recess, and said shearing wave shapes of said upper and lower structures having vertical shearing edges which cooperate upon being pressed together with said first and second cables therebetween to shear strips of said conductor and extrude said sheared strips into said opposing relief recesses so that thus-sheared edges of said extruded conductor strips are disposed against metal surfaces defining side edges of adjacent ones of said wave shapes for electrical connection therewith.

2. An interconnection as set forth in claim 1 wherein each said upper and lower structure includes an adapter member disposed adjacent a major surface of one of said first and second cables, and an insert member disposed securely along a cable-remote surface of a respective said adapter member, wherein said insert members provide a substantial portion of the electrical engagement surface adjacent said thus-sheared edges of said extruded conductor strips.

3. An interconnection as set forth in claim 2 wherein each said insert member of said upper and lower structure includes lateral flange sections extending outwardly beyond lateral edges of said first and second cables, said flange sections including aligned apertures vertically therethrough through which rivet members are inserted and staked, locking said insert members together with said adapter members and said first and second cable sections tightly secured therebetween.

4. An interconnection as set forth in claim 1 wherein said first and second cables are single conductor cables, and said upper and lower structures have alternating wave shapes and relief recesses extending entirely across the cable-proximate surfaces thereof, defining a plurality of interlocking wave joints transversely across the single conductors of said first and second cables.

5. An interconnection as set forth in claim 4 wherein a pair of said interconnecting structure assemblies interconnect said first and second cables.

6. An interconnection as set forth in claim 1 wherein each of said first and second cables includes first and second flat conductors spaced from each other, said first conductors interconnected together by a first said interconnecting structure assembly and said second conductors interconnected together by a second said interconnecting structure assembly;

said first interconnecting structure assembly having said shearing wave shapes and relief recesses only along portions of said cable-proximate surfaces of said upper and lower structures adjacent said first conductors of said first and second cables, and the remaining portions of said cable-proximate surfaces thereof are adapted not to shear nor electrically engage said second conductors;

said second interconnecting structure assembly having said shearing wave shapes and relief recesses only along portions of said cable-proximate surfaces of said upper and lower structures adjacent said second conductors of said first and second cables, and the remaining portions of said cable-proximate surfaces thereof are adapted not to shear nor electrically engage said first conductors.

7. An interconnection as set forth in claim 6 wherein said remaining portion of said cable-proximate surface of one of said upper and lower structure of said first interconnecting structure assembly is adapted to extrude said second conductors out of the plane of said first and second cables.

8. An interconnection as set forth in claim 6 wherein each said first and second interconnecting structure define cable exits which are spaced axially from said wave joints with said first and second cables to protect the terminations from torque and vertical bending of said first and second cables.

9. An interconnection as set forth in claim 6 wherein said first and second interconnecting structure assemblies and adjacent sections of said first and second cables are disposed in housing means.

10. An interconnection as set forth in claim 1 wherein said selected section of one of said first and second cables is an end section, and said interconnection defines a tap connection of a tap cable to a main cable.

11. An assembly for interconnecting first and second flat power cables each having at least one flat conductor therein, comprising:

at least one interconnecting structure assembly corresponding to each said at least one conductor, each said assembly having an upper structure and a lower structure with selected sections of said first and second cables disposed therebetween, each said assembly having a plurality of shearing wave shapes alternating with relief recesses along a cable-proximate surface of said upper structure, and a cooperating plurality of shearing wave shapes and alternating relief recesses along a cable-proximate surface of said lower structure, each said wave shape being opposed by a said relief recess, and said shearing wave shapes of said upper and lower structures having vertical shearing edges which cooperate upon being pressed together with said first and second cables therebetween to shear strips of said conductor and extrude said sheared strips into said opposing relief recesses so that thus-sheared edges of said extruded conductor strips will be disposed against electrical engagement surfaces defining side edges of adjacent ones of said wave shapes for electrical connection therewith.

12. An assembly as set forth in claim 11 wherein each said upper and lower structure includes an adapter member disposed adjacent a major surface of one of said first and second cables, and an insert member disposed securely along a cable-remote surface of a respective said adapter member, wherein said insert members provide upon termination to said first and said cables a substantial portion of the electrical engagement surfaces adjacent said thus-sheared edges of said extruded conductor strips.

13. An assembly as set forth in claim 12 wherein each said insert member of said upper and lower structure includes lateral flange sections extending outwardly beyond lateral edges of said first and second cables, said flange sections including aligned apertures vertically therethrough through which rivet members are to be inserted and staked to lock said insert members together, with said adapter members and said first and second cable sections tightly secured therebetween.

14. An assembly as set forth in claim 11 wherein said first and second cables are single conductor cables, and said upper and lower structures have alternating wave shapes and relief recesses extending entirely across the cable-proximate surfaces thereof, defining a plurality of interlocking wave joints transversely across the single conductors of said first and second cables.

15. An assembly as set forth in claim 14 wherein a pair of said interconnecting structure assemblies interconnect said first and second cables.

16. An assembly as set forth in claim 11 wherein each of said first and second cables includes first and second flat conductors spaced from each other, said first conductors interconnected together by a first said interconnecting structure assembly and said second conductors interconnected together by a second said interconnecting structure assembly;

said first interconnecting structure assembly having said shearing wave shapes and relief recesses only along portions of said cable-proximate surfaces of said upper and lower structures adjacent said first conductors of said first and second cables, and the remaining portions of said cable-proximate surfaces thereof are adapted to traverse and not shear nor electrically engage said second conductors;

said second interconnecting structure assembly having said shearing wave shapes and relief recesses only along portions of said cable-proximate surfaces of said upper and lower structures adjacent said second conductors of said first and second cables, and the remaining portions of said cable-proximate surfaces thereof are adapted to traverse and not shear nor electrically engage said first conductors.

17. An assembly as set forth in claim 16 wherein said remaining portion of said cable-proximate surface of one of said upper and lower structure of said first interconnecting structure assembly is adapted to extrude said second conductors out of the plane of said first and second cables.

18. An assembly as set forth in claim 16 wherein said first and second interconnecting structure assemblies and adjacent sections of said first and second cables are disposed in housing means.

19. An assembly as set forth in claim 18 wherein said housing means comprise upper and lower housing members latchable together after termination of said first and second interconnecting structure assemblies to said first and second cables, with the assemblies disposed within respective cavities defined by said upper and lower housing members.

20. An assembly as set forth in claim 19 wherein said housing members together are adapted to fit closely around said interconnecting structure assemblies and adjacent sections of said first and second cables.

21. An assembly as set forth in claim 20 wherein said housing members define cable exits which are spaced axially from proximate portions of said interconnecting structure assemblies to protect the terminations from torque and vertical bending of said first and second cables.

22. An assembly as set forth in claim 11 wherein said selected section of one of said first and second cables is an end section, and said interconnection defines a tap connection of a tap cable to a main cable.

23. A method of interconnecting two flat power cables each having at least one flat conductor therein, comprising the steps of:

stacking selected sections of first and second flat cables one atop the other with the at least one conductor parallel with the at least one conductor of the other, said selected sections to be interconnected, and said parallel at least one conductors defining a corresponding at least one pair of conductors to be electrically interconnected;

selecting at least one interconnecting structure assembly corresponding to each said at least one pair of conductors, each said assembly having an upper structure and a lower structure with said selected sections of said first and second cables disposed therebetween, each said assembly having a plurality of shearing wave shapes alternating with relief recesses along a cable-proximate surface of said upper structure and coextending transversely with said corresponding pair of conductors, and a cooperating plurality of shearing wave shapes and alternating relief recesses along a cable-proximate surface of said lower structure and coextending transversely with said corresponding pair of conductors, each said wave shape being opposed by a said relief recess, and said shearing wave shapes of said upper and lower structures having vertical shearing edges which cooperate upon being pressed together with said first and second cables therebetween to shear strips of said corresponding pair of conductors and create thus-sheared conductor edges;

placing a said lower structure beneath said stacked cables extending transversely thereunder along a major surface of the lower one of said first and second cables, and placing a said upper structure atop said stacked cables extending transversely thereacross along a major surface of the upper one of said first and second cables and vertically aligned with said lower structure, with said wave shapes of each of said upper and lower structures vertically aligned with said relief recesses of the other thereof; and pressing said upper and lower interconnecting structures together, with said alternating wave shapes shearing said corresponding conductors and extruding thus-sheared strips of said conductors into opposed said relief recesses forming a series of interlocking wave joints transversely across said corresponding pair of conductors and moving said thus-sheared edges of said conductors adjacent electrical engagement surfaces of said upper and lower interconnecting structures defined by vertical side edges of adjacent ones of said wave shapes for electrical connection therewith.

24. A method as set forth in claim 23 wherein each said upper and lower structure includes lateral flange sections extending outwardly beyond lateral edges of said first and second cables and said flange sections each include cooperating alignment apertures therethrough, and said placing step includes placing said upper and lower structures on alignment pins of terminating apparatus extending through said alignment apertures, thus aligning said upper and lower structures and thereby aligning said wave shapes and relief recesses thereof to facilitate appropriate shearing of said corresponding pair of conductors.

25. A method as set forth in claim 23 wherein each said upper and lower structure includes lateral flange sections extending outwardly beyond lateral edges of said first and second cables, said flange sections including aligned rivet-receiving apertures vertically therethrough, and further including the steps of inserting rivet members through said vertically aligned rivet-receiving apertures and staking said rivets to lock said upper and lower structures together, with said first and second cable sections tightly secured therebetween.

26. A method as set forth in claim 25 further including the step of securing a said rivet member in a said rivet-receiving aperture of one of said upper and lower structure prior to said placing step so that an unheaded shank end extends toward said rivet-receiving aperture of the other of said upper and lower structure to be received therethrough during said pressing step.

27. A method as set forth in claim 23 further including the step of securing a housing means around said interconnecting structure assembly terminated to said first and second cables.

28. A method as set forth in claim 23 wherein each of said first and second cables includes first and second flat conductors spaced from each other, said first conductors to be interconnected and said second conductors to be interconnected together, wherein:

said selecting step comprises selecting first and second interconnecting structure assemblies, said first and second interconnecting structure assemblies each having said shearing wave shapes and relief recesses only along portions of said cable-proximate surfaces of said upper and lower structures to be disposed adjacent only one of said first and second conductors of said first and second cables, and the remaining portions of said cable-proximate surfaces thereof are adapted to traverse and not to shear nor electrically engage the other of said first and second conductors;

said placing step includes placing a said lower structure of said first interconnecting structure assembly transversely under said stacked cables with said wave shapes disposed under said first conductors, and placing a said upper structure correspondingly transversely over said stacked cables and aligned above said lower structure corresponding thereto with said wave shapes thereof disposed over said first conductors, and said placing step further includes placing a said lower structure of said second interconnecting structure assembly transversely under said stacked cables axially spaced along said stacked cables a selected distance from said lower structures of said first interconnecting structure assembly with said wave shapes disposed under said second conductors, and placing a said upper structure correspondingly transversely over said stacked cables and aligned above said lower structure corresponding thereto with said wave shapes thereof disposed over said second conductors; and said pressing step includes pressing together said upper and lower structures of said first interconnecting structure assembly and pressing together said upper and lower structures of said second interconnecting structure assembly, whereby said first interconnecting structure assembly interconnects said first conductors and said second interconnecting structure assembly interconnects said second conductors.

29. A method as set forth in claim 28 further including the step of securing a housing means around said first and second interconnecting structure assemblies terminated to said first and second cables, with each said assembly insulated from the other thereof by portions of said housing means.

* * * * *